US007178558B2

(12) United States Patent
Nayfeh et al.

(10) Patent No.: US 7,178,558 B2
(45) Date of Patent: Feb. 20, 2007

(54) MODULAR WEAVING FOR SHORT PRODUCTION RUNS

(75) Inventors: Samir A. Nayfeh, Somerville, MA (US); Jonathan D. Robrs, South Deerfield, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 124 days.

(21) Appl. No.: 11/113,510

(22) Filed: Apr. 25, 2005

(65) Prior Publication Data

US 2006/0249217 A1 Nov. 9, 2006

(51) Int. Cl.

| | |
|---|---|
| ***D03D 49/00*** | (2006.01) |
| ***D03D 49/02*** | (2006.01) |
| ***D03D 49/60*** | (2006.01) |
| *D03D 51/02* | (2006.01) |
| *D03D 41/00* | (2006.01) |

(52) U.S. Cl. ..... 139/11; 139/1 E; 139/56; 139/349

(58) Field of Classification Search ..... 139/1 E, 139/11, 24, 35, 56, 66 A, 99, 449, 224 R, 139/34, 9

See application file for complete search history.

(56) References Cited

U.S. PATENT DOCUMENTS

| | | | | |
|---|---|---|---|---|
| 2,564,677 A | | 2/1951 | Kane | |
| 3,224,465 A | | 12/1965 | Fontaine | |
| 3,432,117 A | * | 3/1969 | Leger | 242/131 |
| 3,432,118 A | * | 3/1969 | Carruthers | 242/131.1 |
| 4,105,052 A | * | 8/1978 | Trost et al. | 139/101 |
| 4,170,249 A | * | 10/1979 | Trost | 139/11 |
| 4,760,628 A | | 8/1988 | Kaufmann et al. | |
| 4,850,399 A | * | 7/1989 | Linka et al. | 139/436 |
| 4,887,650 A | | 12/1989 | McGinley | |
| 4,972,562 A | | 11/1990 | Tanaka et al. | |
| 5,174,000 A | * | 12/1992 | Wilhelm et al. | 28/205 |
| 5,200,904 A | * | 4/1993 | Tottman | 700/131 |
| 5,253,404 A | * | 10/1993 | Weber et al. | 28/204 |
| 5,274,894 A | * | 1/1994 | Wilhelm et al. | 28/202 |
| 5,355,566 A | * | 10/1994 | Eglseer et al. | 28/202 |
| 5,371,930 A | | 12/1994 | Lindenmueller et al. | |
| 5,381,594 A | * | 1/1995 | Piccirillo et al. | 28/208 |
| 5,475,906 A | * | 12/1995 | Magdika | 28/205 |
| 5,505,231 A | * | 4/1996 | Bassing | 139/188 R |
| 5,518,038 A | * | 5/1996 | Steiner | 139/28 |
| 5,645,111 A | * | 7/1997 | Lindblom | 139/55.1 |
| 5,657,796 A | * | 8/1997 | Steiner | 139/28 |
| 6,135,163 A | * | 10/2000 | Wahhoud et al. | 139/114 |

(Continued)

OTHER PUBLICATIONS

P.R. Lord and M.H. Mohamed. *Weaving: Conversion of Yarn to Fabric,* 2nd ed.Shildon, England: Merrow Publishing, 1982. (pp. 289-324).

*Primary Examiner*—Robert H Muromoto, Jr.
(74) *Attorney, Agent, or Firm*—Sampson & Associates P.C.

(57) ABSTRACT

A modular weaving machine includes a loom chassis and a plurality of modular warp units. The warp units are each configured for being pre-loaded with a plurality of warp threads. The loom chassis is configured to receivably support the warp units thereon, so that the warp threads are disposed in parallel, spaced relation to one another, extending in a downstream direction. A plurality of shedding actuators are coupled to the loom chassis and configured to form a shed with warp threads of each of the warp units. A weft insertion module is configured to insert a weft thread through the shed.

33 Claims, 5 Drawing Sheets

U.S. PATENT DOCUMENTS 6,249,939 B1 6/2001 Kremer
6,314,628 B1 11/2001 Crook
6,397,443 B1 * 6/2002 Good et al. ..... 28/206
6,494,235 B1 12/2002 Bruyere et al.
6,892,766 B2 * 5/2005 Bryn et al. ..... 139/11

* cited by examiner

MODULAR WEAVING FOR SHORT PRODUCTION RUNS

BACKGROUND

1. Technical Field

This invention relates to weaving equipment, and more particularly to a weaving machine.

2. Background Information

Throughout this application, various publications, patents and published patent applications are referred to by an identifying citation. The disclosures of the publications, patents and published patent applications referenced in this application are hereby incorporated by reference into the present disclosure.

A wide variety of disparate weaving apparatuses have been used in the textile industry. Modern textile factories utilize sophisticated technology to automate many aspects of the weaving process. Such automation has had the effect of greatly reducing many of the costs associated with finished fabric. However, the weaving process typically relies on relatively complex set-up procedures, in which the warp threads to be woven into the finished bolt of fabric must be wound onto a beam, and individually drawn through heddles and a reed(s) prior to commencement of weaving operations. Although this process is typically automated, it must generally be completed before weaving is commenced, i.e., prior to weaving each bolt of fabric.

The nature of these set-up operations provides a number of burdens on the textile manufacturer. Firstly, both the looms and the set-up equipment (creel, beaming machines, drawing machines) represent a substantial monetary investment. As such, it is desirable to operate them with as little downtime as possible, in order maximize the return on this capital investment. This effectively bars the dedicated use of particular set-up equipment for a particular loom, instead requiring the use of the set-up equipment to be shared among several looms. This complicates the task of scheduling the preparation and weaving operations, and in particular it increases the chances that the weaving of some particular fabric will be delayed because set-up equipment is occupied in preparing for some other piece of fabric.

Secondly, the physical movement of the warp threads in various stages of preparation (spools, beam, drawn-in beam) from one dedicated piece of equipment to another, and the warp threads' installation and removal from said equipment, are operations that are time-consuming and have been automated to a markedly more-limited extent. This aspect provides a strong incentive for loom operators to wind the beam with ever-longer warp threads, often of thousands of meters in length, to minimize the number of these secondary set-up operations that must be executed per unit of fabric woven. However, use of such long warp threads may complicate set-up, and generally militates against relatively short production runs. Furthermore, it decreases the ability of the textile manufacturer to adjust production according to new information about product demand, flaws in raw materials, or errors in weave preparation that may be available only after weaving has commenced.

Accordingly, a need exists for a loom that may be quickly and easily set-up to utilize relatively short warp threads, e.g., to facilitate short production runs with short lead-time. It is also desirable to enable the use of such short warp threads without limiting the overall length of the bolt of fabric produced thereby.

SUMMARY

In one aspect of the invention, a modular weaving machine includes a loom chassis and a plurality of modular warp units. The warp units are each configured for being pre-loaded with a plurality of warp threads extending in parallel relation to one another. The loom chassis is configured to receivably support the warp units thereon, so that the warp threads are disposed in parallel, spaced relation to one another, extending in a downstream direction. A plurality of shedding actuators are coupled to the loom chassis and configured to form a shed with warp threads of each of the warp units. A weft insertion module is configured to insert a weft thread through the shed.

In another aspect of the invention, a modular weaving machine includes a loom chassis and a plurality of modular warp units. The warp units are each configured for supporting a plurality of warp threads extending from a beam. The warp units also include a plurality of heddles configured for respectively receiving one of the warp threads therein, and a reed portion including a plurality of blades interspersed among the warp threads. The loom chassis is configured to receivably support the warp units therein, so that the warp threads of the warp units each extend in a downstream direction from the beams in parallel, spaced relation to one another. A plurality of heddle actuators are coupled to the loom chassis, and configured to selectively actuate the heddles of each of the warp units to effect collective shedding of the warp threads. A weft insertion module configured to insert a weft thread among the warp threads during the collective shedding.

In a further aspect of the invention, a method of weaving includes loading a plurality of warp threads onto a plurality of modular warp units, so that the warp threads extend in parallel, spaced relation thereon. The method also includes placing the warp units onto a loom chassis configured to receivably support the warp units therein, so that the warp threads of each of the warp units are disposed in parallel, spaced relation to one another. A shedding actuator coupled to the loom chassis is used to form a shed of the warp threads. A weft insertion module coupled to the loom chassis is used to insert a weft thread through the shed as it is formed, while others of the modular warp units are loaded.

BRIEF DESCRIPTION OF THE DRAWINGS

The above and other features and advantages of this invention will be more readily apparent from a reading of the following detailed description of various aspects of the invention taken in conjunction with the accompanying drawings, in which.

DETAILED DESCRIPTION

Figure 1:
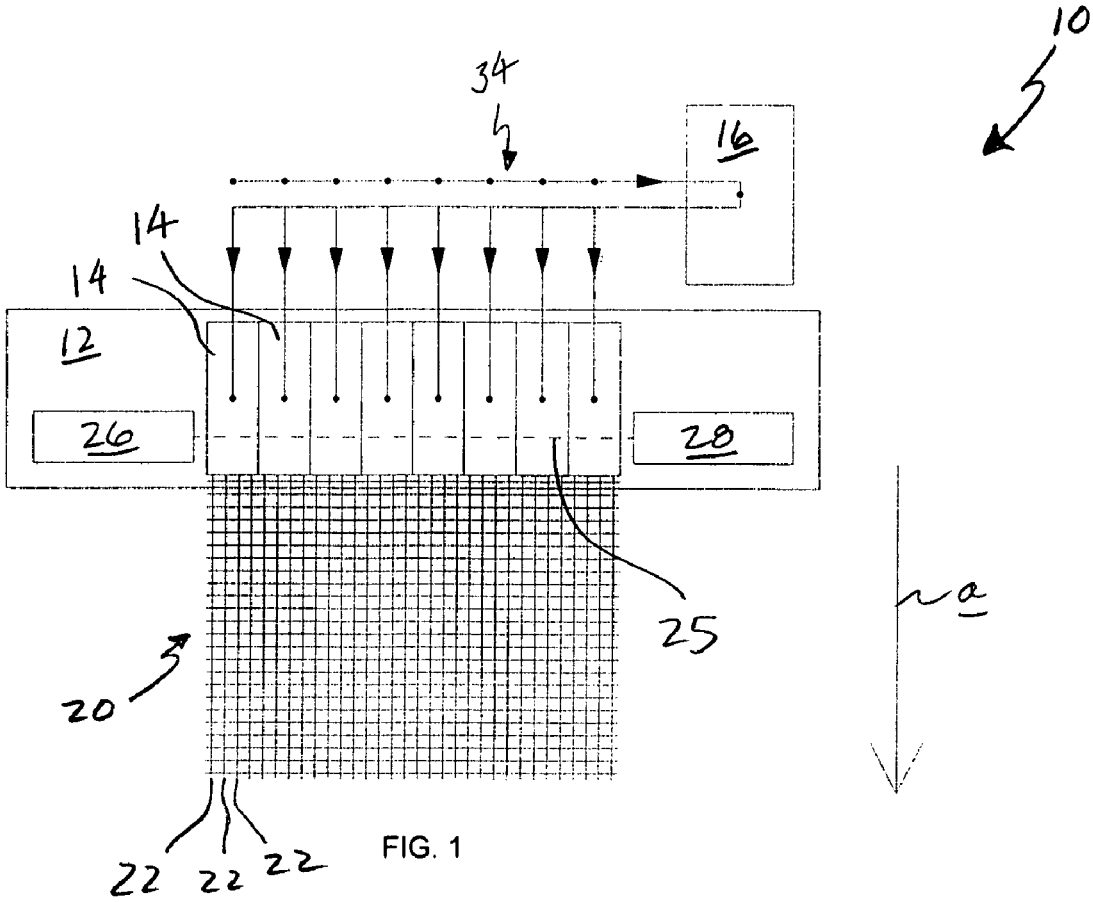
FIG. 1 is a schematic plan view of an embodiment of a weaving system of the present invention in batch mode operation.
Figure 2:
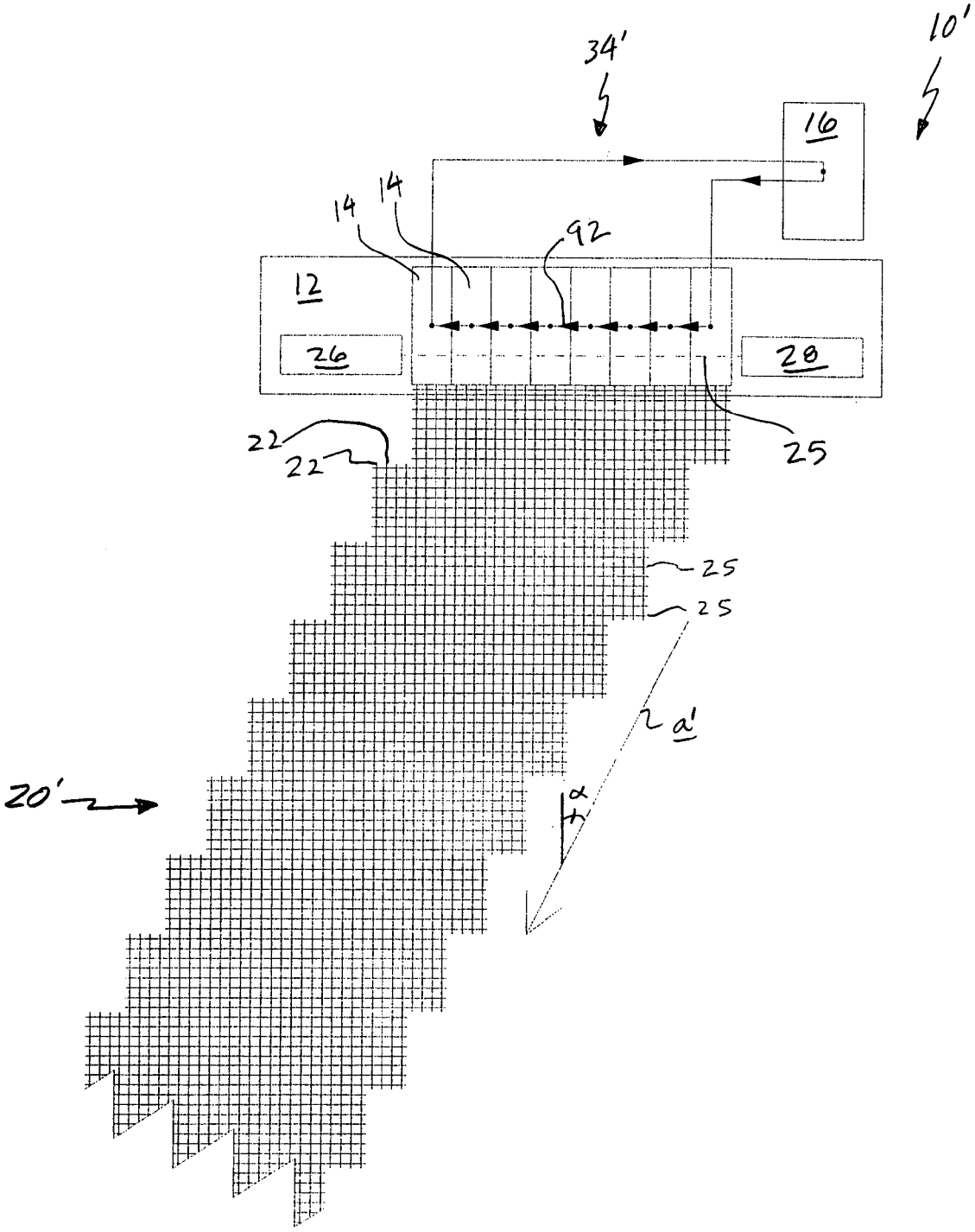
FIG. 2 is a view similar to that of FIG. 1, of the weaving system in continuous mode operation.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings shall be indicated with like reference numerals and similar features as shown in alternate embodiments in the drawings shall be indicated with similar reference numerals.

Where used in this disclosure, the term "downstream" when used in connection with an element described herein, refers to a direction relative to the element, which, when installed onto loom chassis 12, is substantially parallel to the direction with which warp threads 22 are payed-out as they are woven, as shown in FIGS. 1 and 2. The term "upstream" refers to a direction opposite the downstream direction. The terms "transverse" and "lateral" refer to directions other than substantially parallel to the upstream and downstream directions.

Overview

Referring to FIGS. 1 and 2, embodiments of the present invention include a modular weaving machine 10, 10' having at least two major modules: a loom chassis 12 and a series of warp units 14. An optional third module, is referred to as warp loader 16. This modularity provides these embodiments with versatility to operate in batch or continuous modes. In continuous mode, warp threads may be shorter in length than that of the finished fabric.

The loom chassis 12 and the warp units 14, together, may be used to weave fabric 20, 20'. Each warp unit 14 performs warp-handling functions required for weaving a relatively narrow strip portion of fabric 20, 20', including shedding and storage of a predetermined number of warp threads 22 associated with the strip. Each warp unit 14 also includes a reed portion 24 (FIG. 3) for beating-up that strip of fabric. The loom chassis 12 provides for the handling of weft (e.g., fill) thread, including the insertion and storage of unwoven weft thread 25, using weft insertion modules 26, 28 disposed on opposite sides of the array of warp units 14 as shown. Loom chassis 12 also provides take-up motion for the woven fabric 20, 20', actuation of various components of warp-units 14, and includes provisions for receiving and optionally laterally moving the warp units 14.

During weaving operation, one or more warp units 14 may be installed into loom chassis 12 using a transport device 34, 34' associated with warp loader 16. At each warp unit 14, the combination of its warp threads 22 and weft threads from the weft insertion modules 26, 28, produces a woven strip portion of fabric which is approximately the same width as the warp unit itself. Two or more warp units 14 may be positioned adjacent to one another as shown, so that the strip portions are merged to form a proportionally wider fabric 20, 20' as shown. Advantageously, there are no seams in the fabric between adjacent strip portions, since the weft thread 25 runs continuously across all warp units 14, and the warp threads 22 from all of the warp units are spaced evenly relative to one another.

In the embodiment of FIG. 2, warp units 14 are cycled laterally respectively into and out of an ongoing weaving operation. This action advantageously enables production of a fabric 20' of effectively infinite length, using short warp threads 22. This provides fabric 20' with a longitudinal axis a' disposed at an oblique angle $\alpha$ to warp threads 22. In addition, warp units 14 may be loaded off-line and then cycled into the ongoing weaving operation, to effectively permit weaving to be effected continuously, with no downtime for 'drawing-in' warp threads, etc.

Figure 3:
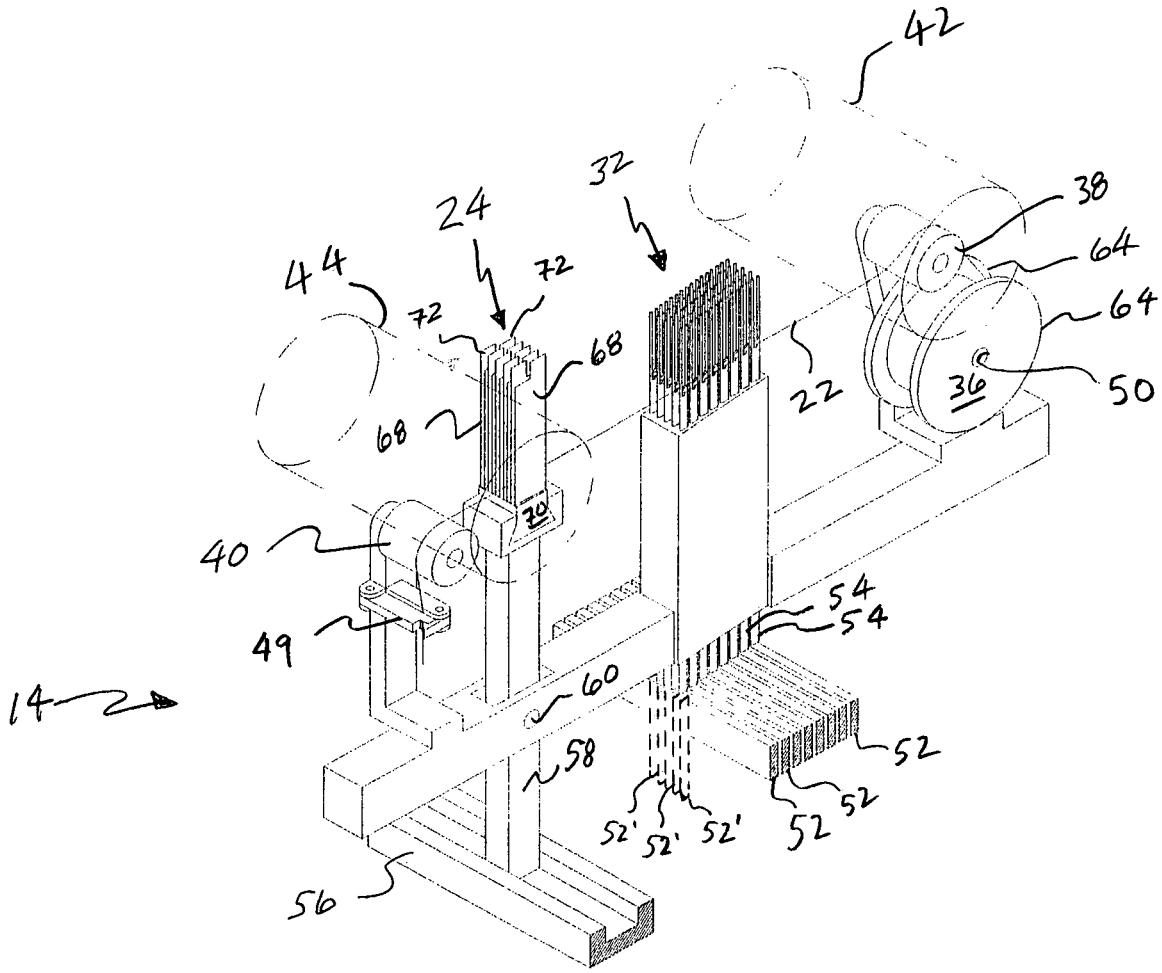
FIG. 3 is an isometric view, on an enlarged scale, of a warp unit portion of the embodiment of FIGS. 1 and 2, with warp-unit-actuating parts of the loom chassis, and portions thereof shown in phantom.
Figure 4:
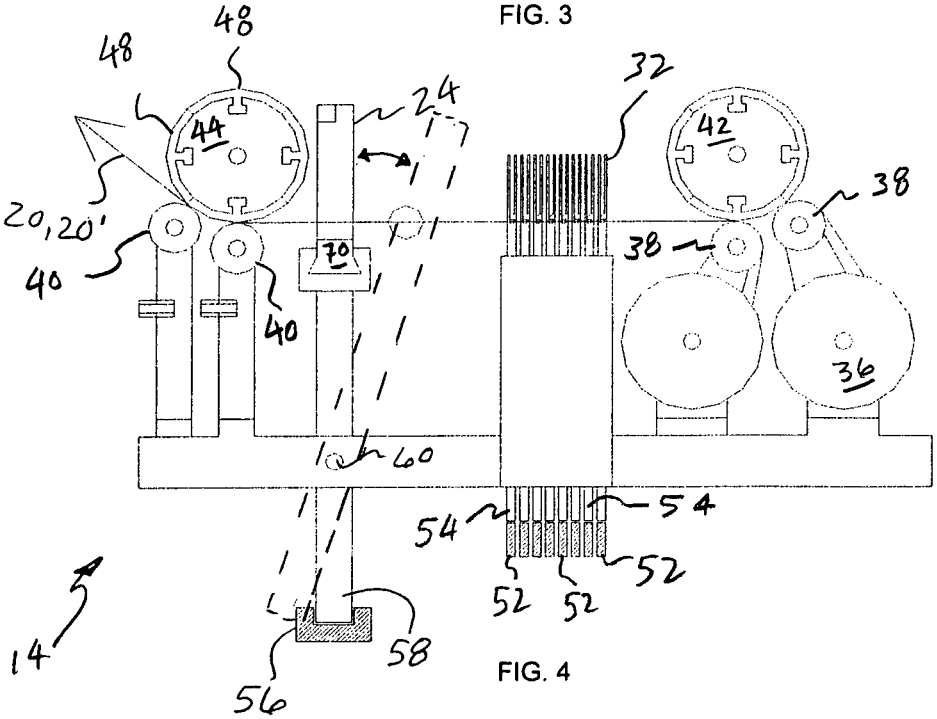
FIG. 4 is an elevational side view of the components of FIG. 3.

In this regard, warp loader 16 may be used to load warp thread 22 into warp units 14 for transport into chassis 12. This loading includes properly winding warp thread 22 into the units 14, and drawing the warp thread through integral heddles 32 and reed 24 (FIGS. 3 and 4).

Loading a warp unit is therefore analogous to conventional 'setting-up' and 'drawing-in' a loom. However, in such conventional looms, all drawing-in must generally occur before any weaving commences. This contrasts with the modular weaving machine 10, 10', in which the aforementioned use of discrete warp units 14 enables warp threads 22 to be set-up independently of the weaving operation, e.g., after weaving commences.

This mode of set-up also differs from typical automated set-up of conventional looms. Generally, conventional automated set-up is performed on all threads before moving to the next operation. That is, all warp threads are beamed (i.e., wound around a beam or spool) and then all are drawn-in, before weaving commences. Conversely, on machine 10, 10', all set-up operations are performed on a particular subset of threads 22 (i.e., those of a particular warp unit 14), before moving to the next group of threads 22.

Embodiments of the present invention thus provide a loom that tends to reduce downtime, by use of individual warp units that may be set-up off-line and subsequently inserted into the loom. These embodiments also facilitate the use of relatively short warp threads, e.g., to facilitate short production runs such as in batch mode operation. Moreover, these embodiments may also be operated in continuous mode, e.g., using relatively short warp threads, without limiting the overall length of the bolt of fabric produced thereby.

Turning now to FIGS. 3–7C, various aspects of the present invention will be described in greater detail.

Warp Units

Referring to FIG. 3 in particular, each warp unit 14 stores unwoven warp threads 22 on a spool-like miniature beam 36. For clarity, only one thread 22 is shown, with the understanding that the warp units may be scaled to support substantially any number of warp threads, ranging from tens to hundreds of threads, depending on the weaving application. From one to forty threads 22 may be supported in the embodiment shown.

Within each warp unit 14, the warp threads 22 run from beam 36, over an upstream roller 38, through heddles 32, through a reed portion 24, and over downstream roller 40. Once the warp unit is installed into the loom chassis 12, rollers 38 and 40 may be respectively engaged by common payout and take-up rollers 42 and 44 to control the pay-out of warp threads 22 and the take-up of the fabric 20, 20', as discussed in greater detail hereinbelow.

Prior to such insertion however, a clamp 49 may be disposed to maintain the positions of the warp threads 22 on the warp unit, e.g., while it is moved from loader 16 (FIGS. 1, 2) to the loom chassis 12. This clamp is released once the warp unit 14 is installed in the loom chassis 12 and engaged by rollers 42 and 44 as discussed below.

Similarly, each warp unit 14 may be equipped with an optional pay-out regulator 50 for regulating the pay-out of warp threads 22 at beam 36. This helps to maintain order among the warp threads while the warp unit is in transit from the warp loader to the loom chassis, e.g., before engagement of warps 22 by pay-out roller 42. Regulator 50 also helps prevent the possibility of tangling or other malfunction due to stray, slack threads between beam 36 and the upstream roller 38. Pay-out regulator 50 may simply be a slight interference fit between the beam and its axle, or any other tension- or displacement-regulating pay-out mechanism known in the textile industry.

Loom Chassis

As best shown in FIG. 4 (and in phantom in FIG. 3), the chassis 12 supports common take-up roller 44 which may be driven in a conventional manner about its rotational axis to provide motive force to pull the warp threads 22 (i.e., in the woven fabric 20, 20', FIG. 4) through the loom as the fabric 20, 20' is woven. This motive force is provided by frictional engagement with the fabric, which is effected by squeezing the fabric against downstream roller 40 of each of the warp units currently engaged in the weaving operation.

The fabric engagement surface of common take-up roller 44 may include sections 48 that are constrained circumferentially and radially relative to the roller, but are configured to permit axial movement. This allows these sections 48 to be moved laterally (e.g., against a bias) with the fabric 20, 20' as the warp units similarly move during weaving operations as discussed below. In this regard, sections 48 are effectively pulled by frictional contact generated by the aforementioned squeezing of roller 44 against downstream roller(s) 40. Once a particular section 48 rotates sufficiently to disengage from fabric 20, 20', it may be biased back to its original position, such as by a spring or a cam.

In the embodiment shown, loom chassis 12 also supports the common pay-out roller 42 which helps (e.g., in combination with optional regulator 50) to control the rate at which warp threads 22 are pulled from beam 36. This common roller pinches the warp threads against upstream roller 38 of the warp units 14, providing a frictional connection with the unwoven warp threads. The pay-out rate may be controlled by applying a torque to roller 42 or by specifying its angular velocity. As with take-up roller 44, sliding surface sections 48 may be used to allow the warp units and warp threads to move laterally relative to the loom chassis as the warp units 14 similarly move.

Although the foregoing embodiments show and describe common pay-out roller 42, those skilled in the art should recognize that in some alternate embodiments, pay-out roller 42 may be omitted, so that pay-out regulator 50 is the sole source of pay-out control for each warp unit 14. Moreover, pay-out roller 42 and/or regulator 50 may be supplemented or replaced by motors, gear trains, actuators, or any number of other devices configured to engage and urge rotation of beams 36 to ensure adequate tension on the warp threads 22.

In addition to supporting warp units 14 and the common pay-out and take-up rollers 42 and 44, the loom chassis 12 also actuates various aspects of the warp units 14 and supports a weft (fill) insertion system. In this regard, loom chassis 12 includes common heddle actuators (e.g., lifting bars) 52 which slidably support ends 54 of heddles 32. Each actuator 52 may be individually moved toward and away from warp unit 14 (e.g., raised and lowered in the embodiment shown), to move the heddles 32 (and the warp threads 22 supported thereby) for shedding. As shown, each actuator 52 engages a subset of the heddles 32 of each warp unit 14, e.g., those heddles laterally aligned with the particular actuator/bar 52.

In this manner, each lifting bar 52 is somewhat analogous to a heddle frame of a conventional loom, in that it defines a set of heddles that are mechanically linked to one another in such a way as to lift and lower in unison. The lifted and lowered heddles cause the warp threads to form a shed through which weft (fill) threads may be passed.

In embodiments of the present invention, the sliding engagement of the actuator/bar 52 with ends 54 of these laterally aligned heddles 32 provides a convenient means for actuating the heddles even as the warp units 14 move laterally during weaving operations, as discussed in greater detail hereinbelow. Moreover, their lateral extension enables each actuator 52 to simultaneously engage ends 54 of heddles of a plurality of adjacent warp units 14, as also discussed hereinbelow.

Although heddle actuators 52 are shown and described as bars upon which ends 54 may slide, in alternate embodiments, individual pushers 52' (shown in phantom, FIG. 3) may respectively engage ends 54 to provide Jacquard-like functionality. When weaving with laterally-moving warp units, e.g. during continuous-mode weaving (FIG. 2), an individual pusher 52' may be brought into alignment with, and used to actuate, a series of different heddle ends 54 as weaving progresses. The pushers 52' therefore may remain laterally stationary relative to the loom chassis or be disposed to move laterally to match the movement of the warp units 14 over a finite distance.

Chassis 12 also includes a common actuating sley 56 which slidably engages a reed sley 58 of warp unit 14. This slidable engagement enables reed sley 58 to slide laterally in a manner similar to that of heddle ends 54 described above. The length of sley 56 also permits it to slidably engage reed sleys 58 of multiple warp units 14. However, rather than moving towards and away from warp units 14 in the manner of actuators 52, sley 56 is movable in the upstream/downstream directions, to pivot each reed portion 24 from an upstream position (shown in phantom) to a downstream position to effect beat-up upon insertion of weft (fill) threads 25 (FIGS. 1 and 2).

Chassis 12 also supports a weft-insertion system, which, in the embodiments shown, includes a pair of weft insertion modules 26 and 28 (FIGS. 1 and 2). These modules pass weft (fill) thread in a conventional manner through sheds (of warp threads 22) formed by actuation of heddle actuators 52 (FIGS. 3 and 4) as discussed hereinabove. Although the weft-insertion system as shown includes two insertion modules, those skilled in the art should recognize that any number of systems may be used, including conventional rapiers or shuttles commonly used in the textile industry. Examples of various suitable weft-insertion systems are described by Lord, P. R., and M. H. Mohamed, on pages 289–324 of *Weaving: Conversion of Yarn to Fabric.* $2^{nd}$ ed. Shildon, England: Merrow Publishing, 1982.

Figure 5:
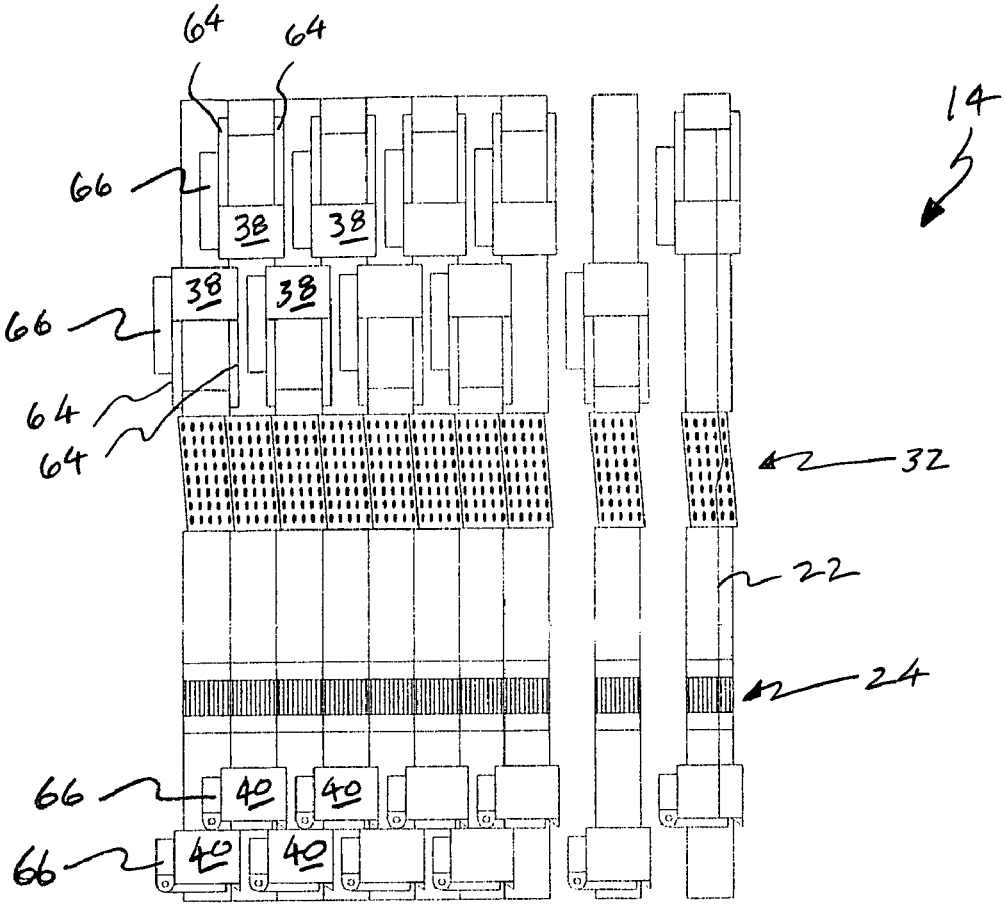
FIG. 5 is a plan view, on an enlarged scale, of the warp units of FIGS. 1 and 2, showing their nested configuration.

Turning now to FIGS. 4–5, as mentioned above, a plurality of warp units may be placed adjacent to one another in loom chassis 12. This enables warp threads 22 on each warp unit to be placed in parallel, spaced alignment with one another to form a warp sheet and heddle array that extend laterally the full width of the desired fabric 20, 20', i.e., 'weave-wide'. Similarly, the reed portions 24 of each warp unit effectively combine to form a weave-wide reed. This combination thus enables the array of adjacent warp units to effectively form a relatively wide loom and fabric.

As also shown, various components of each warp unit 14, however, may extend laterally beyond the strip of warp threads 22 supported thereby. These components may include flanges 64 of beams 36, rollers 38, 40, and structural supports 66 for these components. The rollers 38, 40, for example, are flangeless, and thus should be wider than the strip formed by the warp threads 22 to help ensure that the warp threads to do not fall off the edges thereof. Thus, in order to accommodate these requirements, adjacent warp units 14 are staggered in the downstream/upstream direction. This staggering or nesting thus enables adjacent warp units 14 to be disposed close enough to one another to provide uniform spacing between the warp threads 22, to enable production of a substantially seamless fabric (as described above).

Open Reed and Heddles

Figure 6A:
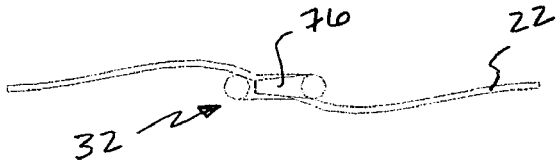
FIGS. 6A and 6B are plan and elevational views, respectively, on an enlarged scale, of heddle and thread portions of FIG. 5.
Figure 6B:
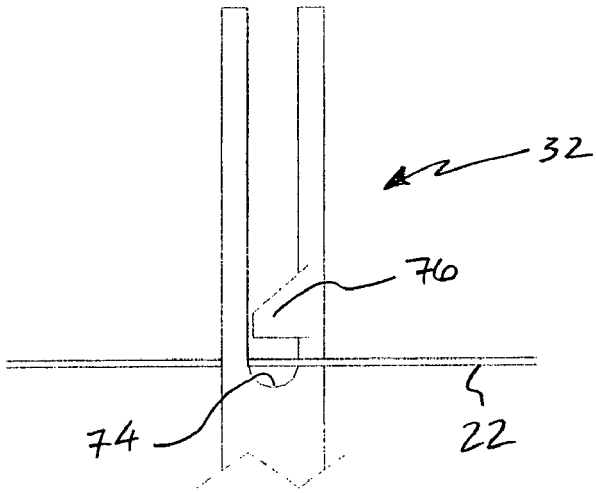

Turning now to FIGS. 6A, 6B, and 3, reed portions 24 and heddles 32 are provided with an open construction, to facilitate the loading of the warp units (discussed below). This open construction eliminates the need, common in the prior art, to push ends of the warp threads 22 through holes in the reed and/or heddles.

Rather, as best shown in FIG. 3, each reed portion 24 includes several cantilevered plates 68 with spaces (dents) between them, extending from a common block 70. Block 70 is supported by reed sley 58. The plates 68 are interposed among warp threads 22, e.g., with a single thread 22 disposed within each dent. During weaving operations sleys 56, 58 are operated as discussed hereinabove, to cycle plates from an upstream position (shown in phantom in FIG. 4) to a downstream position once weft threads 25 are inserted. In this manner, plates 68 cyclically push ('beat-up') the weft thread in the downstream direction after insertion, to form fabric 20, 20'. In particular embodiments, reed portions 24 may be replaced with other reed portions having a different number and size of dents, to permit a user to adjust the sett (warp thread spacing) of the finished fabric 20, 20'.

Warp threads 22 are initially disposed within the dents by placing the threads between the distal ends of the appropriate plates 68. To facilitate this placement, the distal ends may be provided with alternating tabs 72 that may be engaged to bend the plates laterally. By holding alternating stops, the plates may be conveniently released one-by-one, to open sequential dents for loading. Such engagement may be conveniently automated, using any number of well-known approaches. Plates 68 are thus sufficiently thin (i.e., in their lateral dimension) and long to enable their distal ends to be easily moved in the lateral direction upon engagement of tabs 72. They are also sufficiently wide (i.e., in the downstream direction), and their point of engagement with the fell (weft threads) sufficiently close to the support block 70, to provide a stiffness and strength sufficient to resist the beat-up forces.

As best shown in FIGS. 6A and 6B, heddles 32 are forklike, e.g., having two tines. The material connecting the tines, i.e., the bight portion 74 thereof, engages and lifts warp thread 22 when the heddle is lifted. A fluke or barb 76, extending from at least one tine (possibly extending to, or preloading against, the other tine) effectively captures thread 22 within the heddle, to help prevent the thread from becoming disengaged from the heddle during weaving operation. During such operation, heddle 32 may use fluke 76 to effectively pull the thread (e.g., in the downward direction). Alternatively, the heddle may operate primarily by pushing (i.e., against bight 74), using fluke 76 primarily as a safety measure to prevent thread 22 from becoming stuck, for example, in the up position. The tines are relatively elongated, typically extending above the top of the shed formed during weaving operation, to help prevent neighboring warp threads 22 from accidentally entering heddle 32, and provide smooth surfaces for the neighboring threads to rub against, such as shown in FIG. 5.

As also shown in FIG. 5, heddles 32 are arranged on the warp units 14 so their lateral positions substantially match those of the warp threads 22 at maximum thread density. In the event a substitute reed portion having alternate dent spacing is being used, warp threads may simply be placed in heddles that reasonably approximate this alternate spacing. Heddles 32 may be offset from one another in the upstream/downstream direction as shown, to compensate for the large lateral dimension of the heddles relative to the width of threads 22. This offsetting also provides relatively large spacing between the heddles 32, to facilitate loading thereof. To load the thread, the thread is placed between the tines, and pushed below the projection, possibly bending the tines as needed.

Warp Loading

Figure 7A:
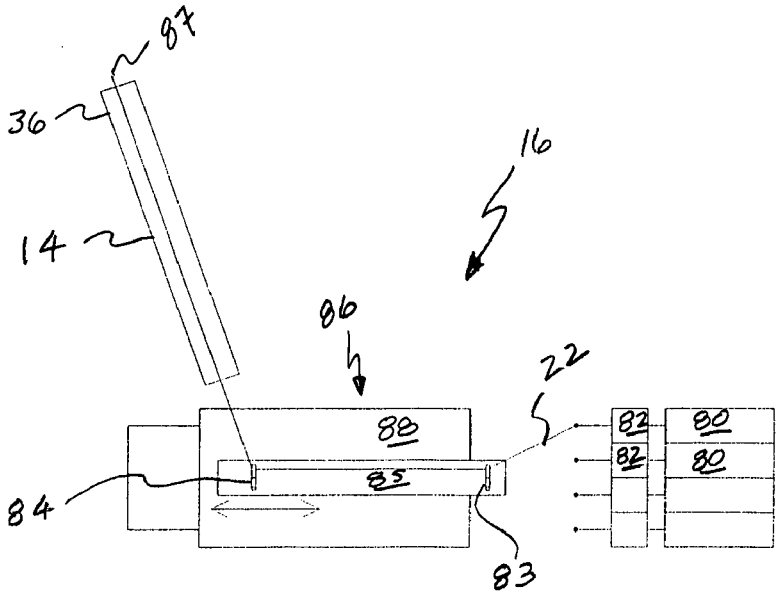
FIGS. 7A, 7B and 7C are schematic plan, front and side views of an embodiment of a warp loader of the present invention.
Figure 7B:
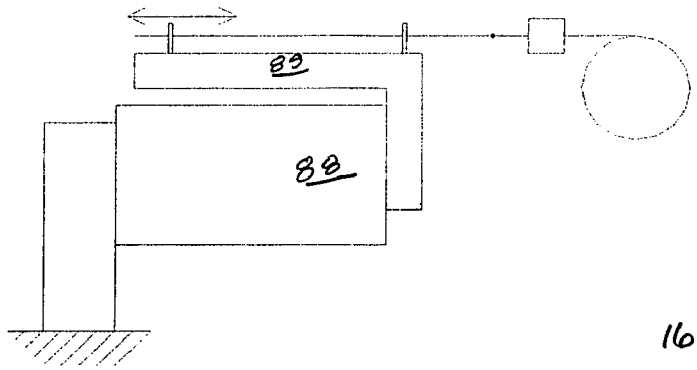
Figure 7C:
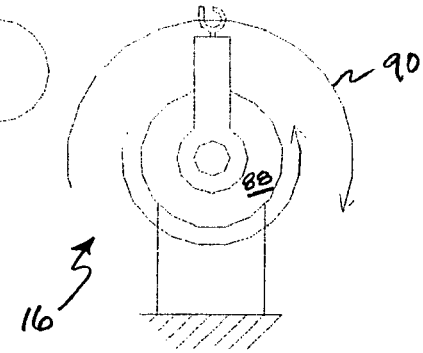

Turning now to FIGS. 7A–7C, warp loader 16 may be provided with several spools 80 of thread 22, likely of different colors and/or materials. Each thread 22 from a spool 80 may be tensioned by its own tensioner 82. To load a warp thread 22 into a warp unit 14, a thread is selected, pulled through respectively stationary and movable guides 83, 84 of arm 85 of a warp accumulator 86. The thread is then pulled over the warp unit 14 to be loaded, and its end 87 is gripped and held at the end of the warp unit 14 proximate beam 36. Then, the thread is introduced into a heddle 32 and reed 24 (FIG. 5) as described hereinabove. Either during or after this introduction, the thread 22 is accumulated on drum 88 of accumulator 86.

This accumulation is accomplished by rotating accumulator arm 85 about drum 88, as shown at 90 in FIG. 7C, while moving thread guide 84 in the axial direction, to wrap the thread helically around accumulator drum 88. The thread is wrapped onto the drum surface, parallel to any other warp threads that have been previously wrapped. This wrapping draws additional thread from the spool 80. When the requisite amount of thread 22 has been wrapped, the thread is gripped to the drum and cut from spool 80.

This accumulation process is repeated serially for each thread that is to be loaded into warp unit 14. When all the warp threads to be loaded have been so processed, the ends 87 of the parallel warp threads 22 are each anchored to beam 36 on the warp unit 14. Then beam 36 and accumulator drum 88 are simultaneously rotated, to feed the set of parallel warp threads 22 from drum 88 onto beam 36. Warp unit 14 may move relative to drum 88 to follow the point where the helix unwinds therefrom.

Once loaded, warp units 14 may be installed into loom chassis 12 using a transport device 34, 34' (FIGS. 1 and 2) associated with warp loader 16. Transport devices 34, 34' may be nominally any conveyance device known to those skilled in the art, including conveyor belts, roller systems, and/or robotic actuators of the type commonly used in conventional factory automation systems. Transport device 34' (FIG. 2) also provides the motive force for moving warp units 14 laterally within loom chassis 12 as discussed herein.

Modes of Operation

Having described various aspects of embodiments of the present invention, the following is a description of the weaving operations thereof. Embodiments of the modular weaving machine may be operated in two modes: batch or continuous, as respectively shown in FIGS. 1 and 2. Turning to FIG. 1, when in batch mode machine 10 produces a rectangular bolt of fabric 20, with the warp threads 22 running parallel to the fabric edge. This may be accomplished by filling warp units 14 as discussed hereinabove, and placing sufficient numbers of them onto loom chassis 12 to achieve a desired fabric width. Weaving is then commenced, and continued without adding or removing warp units, until they are exhausted of warp thread, at which time weaving is terminated and the warp units removed. In this batch mode, the length of fabric 20 is limited by the length of warp thread 22 loaded onto warp units 14. However, while weaving one bolt of fabric, additional warp units for the next bolt of fabric may be loaded, to minimize downtime of loom 10.

As shown in FIG. 2, when in continuous mode, loom 10' may produce an indefinitely long strip of fabric 20', with the warp threads 22 running at an angle $\alpha$ to the longitudinal axis a of the fabric 20'. (The weft threads 25 are perpendicular to warp threads 22). Once weaving commences, the warp units may be moved laterally (e.g., to the left as shown at 92, so that newly-loaded warp units 14 may be added periodically to one side (e.g., the right side) of the loom chassis 12, as emptied warp units 14 are removed from the other (left) side. In this manner, replacement warp units 14 may be loaded while others are actively involved in the ongoing weaving process. Accordingly, weaving may progress indefinitely, with virtually no loom downtime, regardless of the length of the warp threads 22.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

What is claimed is:

1. A modular weaving machine comprising:

a loom chassis;

a plurality of modular warp units;

said warp units each configured for being pre-loaded with a plurality of warp threads;

said warp units each including a plurality of heddles configured for receiving said warp threads;

said loom chassis configured to receivably support said warp units thereon, wherein said warp threads of each of said warp units are disposed in parallel, spaced relation to one another, extending in a downstream direction;

a plurality of shedding actuators coupled to said loom chassis, and configured to form a shed with warp threads of each of said warp units; and a weft insertion module configured to insert a weft thread through the shed.

2. The modular weaving machine of claim 1, wherein said modular warp units each comprise a beam configured to support said warp threads.

3. The modular weaving machine of claim 1, wherein each of said heddles are configured for respectively receiving one of said warp threads.

4. The modular weaving machine of claim 3, wherein said shedding actuators comprise heddle actuators.

5. The modular weaving machine of claim 4, wherein said shedding actuators are configured to selectively actuate said heddles of each of said warp units to form the shed.

6. The modular weaving machine of claim 3, wherein said warp units each include a reed portion disposed downstream of said heddles, said reed portion including a plurality of blades configured for being interspersed among said warp threads.

7. The modular weaving machine of claim 6, wherein said warp units are configured for being loaded with said warp thread when disposed out of said loom chassis.

8. The modular weaving machine of claim 6, wherein said reed portion and said heddles are open in a direction transverse to the downstream direction.

9. The modular weaving machine of claim 6, wherein said loom chassis comprises a common actuating sley disposed to engage and commonly actuate said reed portions of said warp units.

10. The modular weaving machine of claim 9, wherein said warp units each comprise a reed sley disposed to support said reed portion, said reed sley being engagable by said common actuating sley.

11. The modular weaving machine of claim 1, comprising a transport system disposed to selectively deposit and withdrawal individual ones of said warp units to and from said loom chassis.

12. The modular weaving machine of claim 11, wherein said transport system is disposed to selectively deposit and withdraw individual ones of said warp units to and from said loom chassis during weaving operations.

13. The modular weaving machine of claim 1, wherein said loom chassis is configured for cycling said warp units transversely to the downstream direction during weaving operations, wherein a warp unit may be deposited into said loom chassis as another warp unit is withdrawn from said loom chassis.

14. The modular weaving machine of claim 13, comprising a take-up roller disposed on said loom chassis, said take-up roller having a fabric engagement portion configured to move laterally with the fabric during fabric take-up.

15. The modular weaving machine of claim 1, comprising a warp loader configured for simultaneously loading a plurality of warp threads into a warp unit.

16. The modular weaving machine of claim 15, wherein said warp loader comprises an accumulator drum configured to helically wind a plurality of warp threads thereon.

17. The modular weaving machine of claim 16, wherein said accumulator drum is configured to pay out said plurality of helically wound warp threads into a warp unit.

18. The modular weaving machine of claim 16, wherein said warp loader is configured to draw each of said warp threads through one of said heddles and through said reed portion of each of said warp units.

19. A modular weaving machine comprising:

a loom chassis;

a plurality of modular warp units;

said warp units each configured for supporting a plurality of warp threads extending from a beam;

said warp units each having a plurality of heddles, each configured for respectively receiving one of said warp threads therein;

said warp units each having a reed portion including a plurality of blades interspersed among said warp threads;

said loom chassis configured to receivably support said warp units therein, wherein said warp threads of said warp units each extend in a downstream direction from said beams in parallel, spaced relation to one another;

a plurality of heddle actuators coupled to said loom chassis, and configured to selectively actuate said heddles of each of said warp units to effect collective shedding of said warp threads; and a weft insertion module configured to insert a weft thread among said warp threads during the collective shedding.

20. A method of weaving, comprising:

(a) leading a plurality of warp threads onto a plurality of modular warp units, each of said warp units having a plurality of heddles configured for receiving the warp threads therein, wherein the warp threads extend in parallel, spaced relation on said warp units;

(b) placing said warp units onto a loom chassis configured to receivably support said warp units therein, wherein the warp threads of each of said warp units are disposed in parallel, spaced relation to one another;

(c) forming a shed of said warp threads with a shedding actuator coupled to the loom chassis;

(d) inserting a weft thread through the shed with a weft insertion module coupled to the loom chassis; and (e) during said forming (c) and said inserting (d), loading a plurality of warp threads into other modular warp units.

21. The method of claim 20, wherein said loading (a) comprises loading said warp threads onto a beam disposed on each of said modular warp units.

22. The method of claim 20, wherein said loading (a) is effected when the warp units are disposed out of the loom chassis.

23. The method of claim 20, comprising extending each of the warp threads into a heddle disposed on the warp unit.

24. The method of claim 23, comprising selectively actuating the heddles of each of said warp units to form the shed.

25. The method of claim 23, comprising extending each of the warp threads through a reed portion disposed downstream of said heddles on the warp units, the reed portion including a plurality of blades configured for being interspersed among the warp threads.

26. The method of claim 24, comprising collectively actuating the reed portions with a common actuating sley to beat-up the weft thread.

27. The method of claim 20, comprising selectively depositing and withdrawing individual ones of the warp units to and from the loom chassis.

28. The method of claim 27, wherein said selectively depositing and withdrawing is effected during said forming (c) and said inserting (d).

29. The method of claim 20, wherein said loading (a) comprises using a warp loader to simultaneously load a plurality of warp threads into said warp unit.

30. The method of claim 29, comprising helically winding a plurality of warp threads onto an accumulator drum.

31. The method of claim 30, comprising simultaneously paying out said plurality of helically wound warp threads into said warp unit.

32. The method of claim 31, comprising drawing each of said warp threads through one of said heddles and through said reed portion of each of said warp units.

33. A modular weaving machine comprising:

a plurality of modular warp unit means for being preloaded with a plurality of warp threads extending in parallel relation to one another;

each of said plurality of modular warp unit means including heddle means configured for receiving said warp threads therein;

chassis means for receivably supporting said warp unit means thereon, wherein said warp threads of each of said warp unit means are disposed in parallel, spaced relation to one another, extending in a downstream direction;

a plurality of shedding actuation means for forming a shed with warp threads of each of said warp units, said shedding actuation means being coupled to said loom chassis means; and weft insertion means for insert a weft thread through the shed.

* * * * *